US006027106A

United States Patent [19]

Ray

[11] Patent Number: 6,027,106

[45] Date of Patent: Feb. 22, 2000

[54] CLAMP APPARATUS

[75] Inventor: Ernest Brad Ray, Loma Rica, Calif.

[73] Assignee: Ernest B. Ray, Loma Rica, Calif.

[21] Appl. No.: 09/196,045

[22] Filed: Nov. 18, 1998

[51] Int. Cl.[7] ..... B25B 1/08

[52] U.S. Cl. ..... 269/236; 269/203

[58] Field of Search ..... 269/236, 229, 269/235, 196, 198, 205, 910, 224

[56] References Cited

U.S. PATENT DOCUMENTS

| | | | |
|---|---|---|---|
| 724,116 | 3/1903 | Maley . | |
| 1,016,594 | 1/1912 | Woodman . | |
| 1,685,899 | 10/1928 | Andrew . | |
| 2,271,041 | 1/1942 | Stuckert | 269/236 |
| 2,384,148 | 9/1945 | Yeager . | |
| 3,189,341 | 6/1965 | Maurus | 269/236 |
| 4,478,331 | 10/1984 | Ruin . | |
| 4,589,640 | 5/1986 | Pert | 269/196 |
| 4,622,123 | 11/1986 | Nejame | 269/235 |
| 5,718,422 | 2/1998 | Morghen . | |
| 5,816,300 | 10/1998 | Rogers | 269/236 |

*Primary Examiner*—David A. Scherbel
*Assistant Examiner*—Daniel G. Shanley
*Attorney, Agent, or Firm*—Sierra Patent Group

[57] ABSTRACT

A clamp apparatus having a locking body with a tapered lower cam surface, and a stationary mounting member on which the locking body is rotatably mounted. The cam surface is substantially perpendicular to the rotational axis of the locking body to provide a large cam surface area for secure locking and holding of workpieces. A cutout portion on the locking body defines an open position wherein a workpiece can be positioned adjacent to or removed from the clamp apparatus. When the locking body is rotated into a locking position, the tapered cam surface engages and clamps the workpiece beneath the locking body to secure the workpiece in place. A stop or stops on the mounting member prevents the locking body from rotatably moving into unwanted positions. A resilient O-ring positioned between the mounting member and locking body provides traction therebetween.

20 Claims, 3 Drawing Sheets

CLAMP APPARATUS

BACKGROUND OF THE INVENTION

1. Field of the Invention

The invention pertains generally to devices and methods for holding workpieces during machining, welding and other industrial operations. More particularly, the invention is a cam lock clamp apparatus which firmly and releasibly holds a workpiece in a fixed position and which allows quick and easy clamping and releasing of workpieces.

2. Description of the Background Art

During machining, welding, assembly and other industrial operations it is often necessary to hold workpieces firmly in place. A variety of clamping devices and systems have been developed for holding different types of workpieces for different industrial operations. Previously used clamping devices and systems, however, have been subject to some important drawbacks. A particular problem with currently used clamping systems is that vibration from machining, welding or other industrial operations can cause the clamped workpiece to inadvertently shift position or become released from a clamp such that the workpiece and/or machining tools are damaged or destroyed. Even slight shifting of a work-piece during machining can result in a below-tolerance machined workpiece which will be rejected.

Another drawback with presently used clamping systems is that extensive tightening or loosening of numerous screws, and/or placement and removal of holding straps, must be carried out with respect to each workpiece. Such arrangements tend to be complex, involve numerous parts, and require an excessive amount of time to clamp and release each workpiece. Further, clamping systems which can exert substantial pressure on a workpiece tend to rapidly undergo wear at frictional surfaces and require frequent replacement. These problems and others add to the overall time and cost of carrying out various industrial operations on workpieces.

Accordingly, there is a need for a clamp apparatus which firmly secures or locks workpieces in places, which prevents workpieces from undergoing unwanted movement or release during industrial operations, which provides for quick and easy clamping and release of workpieces, and which is simple and inexpensive to install, use, and maintain. The present invention satisfies these needs, as well as others, and generally overcomes the deficiencies found in the background art.

SUMMARY OF THE INVENTION

The present invention is a clamp apparatus which provides for quick and easy releasible holding of a workpiece during industrial operations, and which prevents movement of a workpiece during such operations due to vibration or machining forces exerted against the workpiece. In general terms, the invention comprises a rotatable locking body having a tapered or cam surface which is substantially perpendicular to the rotational axis of the body, a stationary mounting member which is rotatably received by a socket in the locking body, and means for coupling the locking body and mounting member to a work surface or platform. Means for generating traction against the work surface are included on the mounting member, and means for generating traction between the rotating locking body and mounting member are included therebetween.

By way of example, and not of limitation, the locking body comprises a generally annular locking disc or portion that is tapered or pitched in shape such that a cam surface is defined on a lower or inner surface of the locking disc, with the cam surface being nearly perpendicular to the rotational axis of the body. The locking disc thus is eccentric in shape to provide a cam body, but with the axis of eccentricity of the locking disc being generally normal to the rotational axis of the body rather than concentric with the rotational axis. A handle is coupled to the edge of the locking disc. A part of the locking disc is cut away to provide a cutout section with a flat surface on the locking disc edge. The rotating body further comprises a generally cylindrical socket portion joined to the locking disc, with the socket portion having a bore which is coaxial with the rotational axis of the rotating body and generally perpendicular to the locking disc. The bore extends through both the socket portion and disc portion of the rotating body, and a step or shoulder is included within the bore.

The mounting member is of generally cylindrical shape and is structured and configured to be rotationally received by the bore in the locking body. An annular flange or lip is included on a top or outer end of the mounting member, and means for generating traction are included on a lower or inner end of the mounting member, preferably in the form of a plurality of serrations. At least one ear or stop is preferably included on the flange of the mounting member, with the stop being structured and configured to interact with the handle on the locking disc when the locking body is rotated with respect to the mounting member. The flange on the mounting member also includes a cutout section which defines a flat edge on the flange edge. Traction generating means between the mounting member and locking body are provided by an elastomeric "o"-ring, which is positioned between the shoulder in the bore of the locking body and the inner surface of the flange on the mounting member. A bore extends longitudinally through the mounting member and accommodates a screw or bolt which threadedly engages a corresponding threaded hole in a work surface to fixedly hold the mounting member thereto. The locking body rotates about the thusly secured mounting member, with the rotation of the locking body being limited by the stop or stops on the flange of the mounting member.

To assemble and install the clamp apparatus of the invention, the o-ring is fitted onto the shoulder within the bore of the locking body, and the cylindrical mounting member is inserted into the bore of the locking body such that the o-ring is held under the flange of the stopping member. The mounting member is positioned on the work surface such that the bore of mounting member is aligned with the threaded hole in the work surface, and with the flat edge or cut out portion of the flange on the mounting member positioned to face towards a workpiece. The threaded bolt is inserted through the bore of the mounting member and engaged into the threaded hole in the work surface. The serrations on the lower surface of the mounting member frictionally engage the work surface and hold the mounting member stationary while the locking body is allowed rotate about the mounting member. The o-ring between the mounting member and locking body frictionally resists rotation of the locking body about the mounting member. A user applies force to the locking body via the handle to overcome the friction provided by the o-ring and cause the locking body to rotate or pivot about the mounting member.

The locking body is pivotally moved via the handle between an "open" or "release" position, and a "closed" or "locking" position, with the open and closed positions being generally one hundred and eighty degrees of rotation apart with respect to the locking body. In the open position, the cutout portion or flat edge on the disc portion of the locking body is aligned with the cutout portion or flat edge on the flange of the mounting member. In the closed position, the flat edge on the disc portion of the locking body is opposite the flat edge on the flange of the mounting member the of the cam lock member, and a "closed" or locking position in which the locking member flange fits over an adjacent work piece, with the cutout portion of the locking disc flange being generally opposite from cutout portion on the cam lock member flange.

In operation, a user rotates the locking body, by applying force to the attached handle, to move the locking body to the open position wherein the cutout portion of the locking disc is adjacent to the cutout section on the mounting member flange. The user places the workpiece on the work surface and positions an edge of the workpiece adjacent to the cutout portions of the locking disc and mounting member flange. The user then rotates the locking body via the handle to move the locking disc towards the closed position. As the locking disc is rotated towards the closed position, the cutout portion of the locking disc is moved away from the workpiece such that the locking disc extends over the workpiece. Also as the locking disc rotates towards the closed position, the eccentric, tapered shape of the locking disc the taper causes the cam surface on the locking disc to engage the workpiece and apply a locking force thereto to securely hold the workpiece to the work surface. The cam-like effect of the tapered locking disc securely holds the workpiece in place without undergoing unwanted shifting or movement due to vibration. The o-ring between the locking body and mounting member provides traction therebetween to farther prevent inadvertent movement of the locking body which would allow the workpiece to shift. The serrated lower surface of the mounting member frictionally engages the underlying work surface and prevents the mounting member from rotating when the locking body rotates, even when substantial force is applied to the locking body. The relatively inexpensive o-ring is the only portion of the clamp apparatus of the invention which is subject to wear and replacement.

After machining or other operations are carried out on the workpiece, the workpiece may be released from the work surface by rotating the locking body from the closed position to the open position, which disengages the cam surface of the locking disc from the workpiece to remove the locking force, and which also positions the cutout portion of the locking disc adjacent to the workpiece so that the workpiece can be removed from the work surface. The stop on the flange of the mounting member abuts the handle of the locking disc when the locking member is in the open position, thus preventing the locking member from rotating past the open position in a manner which would inconveniently position the handle over the workpiece and thus hinder removal of the workpiece. Two or more clamp apparatus in accordance with the invention are generally employed together on a work surface to hold a workpiece at multiple points, and the above procedure is repeated with respect to the other clamp apparatus.

Traction between the mounting member and locking body is provided by the resilient O-ring positioned therebetween, and the locking body is rotated by applying sufficient force to overcome the traction created by the O-ring. The O-ring is the only portion of the apparatus which experiences substantial wear, and is inexpensive and easy to replace. The invention thus avoids fatigue and wear of more expensive or difficult to replace parts.

An object of the invention is to provide a clamp apparatus which securely holds workpieces during machining, welding, assembly and other industrial operations.

Another object of the invention is to provide a clamp apparatus which does not undergo unwanted loosening or movement due to vibration.

Another object of the invention is to provide a clamp apparatus which quickly and easily secures and releases workpieces.

Another object of the invention is to provide a clamp apparatus which is simple and inexpensive to manufacture and use.

Another object of the invention is to provide a clamp apparatus which minimizes wear and the cost of replacement parts.

Another object of the invention is to provide a clamp apparatus which prevents clamp handles from rotating into positions which could block a workpiece and hinder removal of a workpiece from a work surface.

Further objects and advantages of the invention will be brought out in the following portions of the specification, wherein the detailed description is for the purpose of fully disclosing the preferred embodiment of the invention without placing limitations thereon.

BRIEF DESCRIPTION OF THE DRAWINGS

The present invention will be more fully understood by reference to the following drawings, which are for illustrative purposes only.

DETAILED DESCRIPTION OF THE PREFERRED EMBODIMENTS

Figure 1:
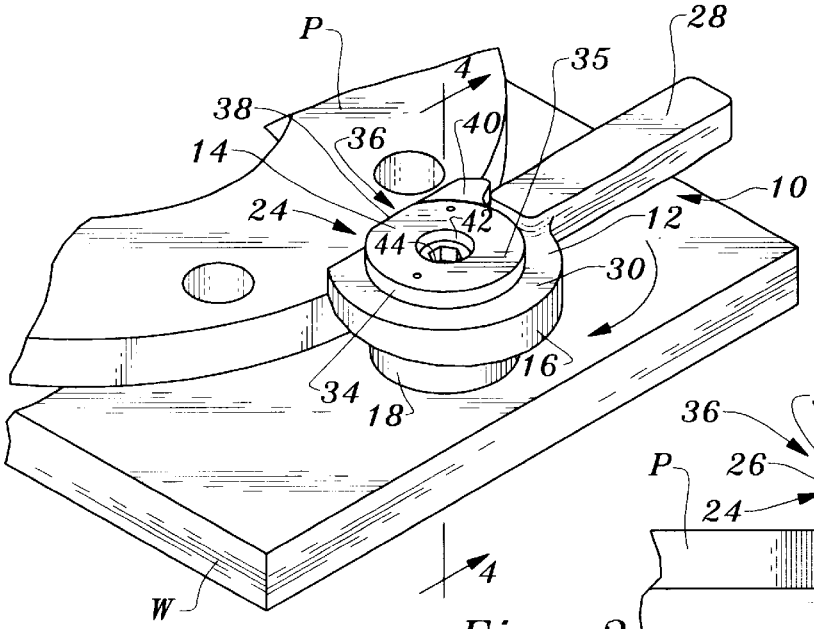
FIG. 1 is a perspective view of a clamp apparatus in accordance with the invention, shown in an open position, together with a portion of a workpiece and work platform.

Referring more specifically to the drawings, for illustrative purposes the present invention is embodied in the apparatus shown generally in FIG. 1 through FIG. 11. It will be appreciated that the apparatus may vary as to configuration and as to details of the parts without departing from the basic concepts as disclosed herein.

Referring now to FIG. 1 through FIG. 10, a clamp apparatus 10 in accordance with the invention is shown. Clamp apparatus 10 comprises generally a rotatable locking body 12 and a stationary mounting member 14. Clamp apparatus 10 is shown mounted on a work surface or work platform W and positioned to hold a workpiece P. Workpiece P is shown as a portion of an annular flange, while work platform W is shown as a portion of a plate or workbench. Work platform W and workpiece P as shown are merely exemplary, and the clamp apparatus 10 of the invention may be mounted on a variety of different work surfaces and can be used to hold or clamp a variety of different types of workpiece.

Locking body 12 preferably comprises a locking or cam disc 16 and a generally cylindrical-shaped socket portion 18 which is joined to locking disc 16. A generally cylindrical bore 20 (FIG. 10) extends through locking disc 16 and socket portion 18 of locking body 12 to rotatably receive mounting member 14. Locking disc 16 has a tapered, pitched or canted lower surface 22 which acts as a cam surface on the bottom of locking disc 16. Preferably, locking disc 16 is tapered in thickness from one side to the other to provide an eccentric shape, as can be seen most clearly in FIG. 5, FIG. 7 and FIG. 9. A cutout portion 24 on locking disc 16 defines a generally flat edge 26 on one side of locking disc 16. A handle 28 is coupled to locking disc 16, with handle 28 preferably being raised or elevated with respect to the top surface 30 of locking disc 16. Handle 28 is preferably positioned adjacent cutout portion 24 as shown. A bevel or chamfer 32 (FIG. 10) is preferably included on lower surface 22 of locking disc 16, with bevel 32 preferably positioned opposite cutout portion 24 and edge 26.

Mounting member 14 is preferably of cylindrical shape and is structured and configured to be rotatably received by bore 20 in locking body 12. An annular flange or lip 34 extends around an upper or top end 35 of mounting member 12. A cutout section 36 of flange 34 defines a generally flat edge 38 on flange 34. An ear or stop 40 is included on flange 34 adjacent cutout section 36 and flat edge 38. Mounting member 14 includes a longitudinal bore 42 which extends through mounting member 14.

Means for fixedly coupling mounting member 14 to work platform W are preferably provided by a threaded bolt or screw 44 which fits through bore 42 in mounting member 14 to engage a threaded hole 46 in work platform W. Bore 42 preferably is not threaded, so that bolt 44 slidably fits therethrough. The coupling means also preferably comprises a plurality of radially extending serrations or grooves 48 (FIG. 10) on a lower surface or end 50 of mounting member 14. Other conventional coupling means may alternatively or additionally be used for fastening mounting member 14 to work platform W.

Bore 20 in locking body 12 includes a step or shoulder 52 (FIG. 4) adjacent the upper surface 30 of locking disc 16. A resilient "O"-ring 54 fits within bore 20 and is positioned between shoulder 52 and flange 34 on mounting member 14 when mounting member 14 is placed within bore 20 of locking body 12. O-ring 54 provides means for generating traction between locking body 12 and mounting member 14.

Figure 4:
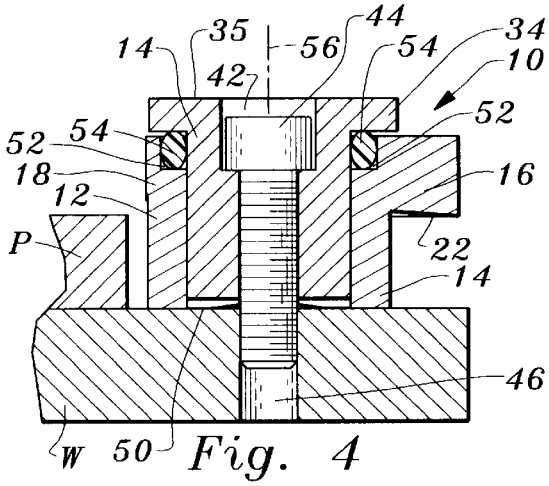
FIG. 4 is a cross-sectional view of the clamp apparatus, work piece and work platform of FIG. 1 shown through line 4—4.
Figure 5:
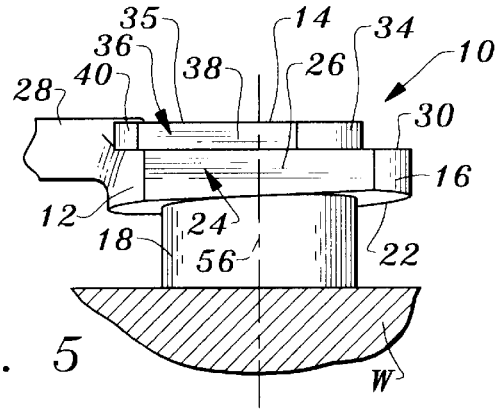
FIG. 5 is a side elevation view of the clamp apparatus of FIG. 1 shown with the work platform in cross-section through line 5—5.

Clamp apparatus 10 is assembled for use by placing O-ring 54 onto shoulder 52 in bore 20, and then inserting mounting member 14 into bore 20 such that O-ring 54 is positioned between shoulder 52 and flange 34 of mounting member 14, as seen most clearly in FIG. 4. The thusly assembled mounting member 14, locking body 12 and O-ring 54 are then coupled to work platform W by inserting bolt 44 through bore 42 in mounting member 14, and threadedly engaging bolt 44 into threaded hole 46 in work platform W. Mounting member 14 is positioned on work platform W such that cutout section 36 of flange 34 is oriented towards a workpiece P when clamp apparatus 10 is in use, as described further below. Once mounting member is thus positioned, bolt 44 is tightened or secured with a suitable tool (not shown) to lock mounting member 14 into place on work platform W. Radially extending serrations 48 on lower surface 50 of mounting member 14 frictionally engage the surface of work platform W to hold mounting member 14 in place. Flange 34 prevents locking body 12 from slipping off mounting member 14 after clamp apparatus 10 has been secured to work platform W. Flange 34 on mounting member 14 could alternatively be replaced by other structural features suitable for holding locking body 12 beneath. Generally, one or more additional clamp apparatus 10 would be employed on work platform W to hold workpiece P, with the number of clamp apparatus 10 utilized varying with the size, shape and nature of the workpiece to be clamped.

When assembled and mounted on work platform W as described above, locking body 12 will rotate about mounting member 14 along a central rotational rotational axis 56 when a suitable force is applied to handle 28 to overcome the friction or traction due to resilient O-ring 54 positioned between locking body 12 and mounting member 14. Locking body 12 rotates about stationary mounting member 14 generally between an open position, shown in FIG. 1 through FIG. 3, and a closed or locking position shown generally in FIG. 8 and FIG. 9. While in the open position, the cutout portion 24 of locking disc 16 is positioned generally adjacent to the cutout section 36 on flange 34 of mounting member, which allows a workpiece P to be positioned adjacent to the socket portion 18 of locking body 12, as can be seen most clearly in FIG. 2 and FIG. 3.

Figure 6:
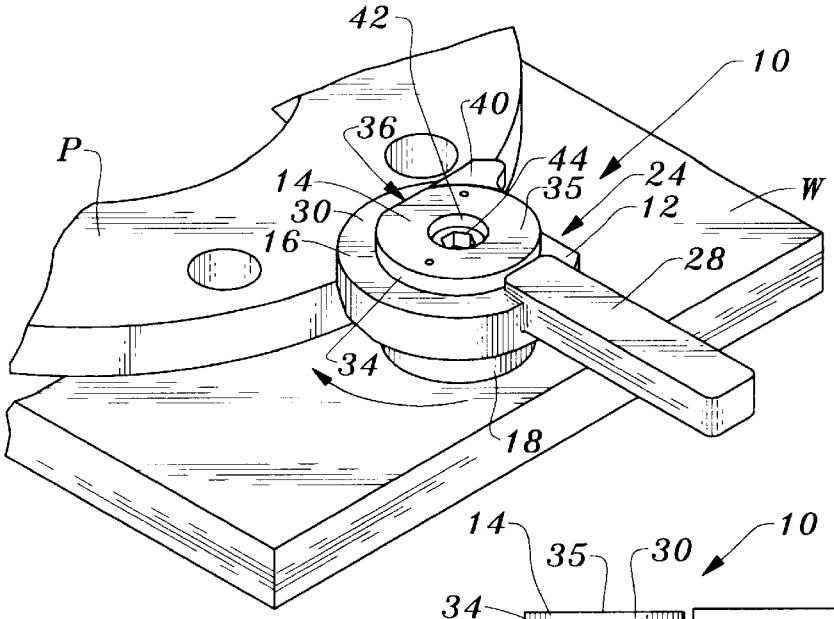
FIG. 6 is a perspective view of the clamp apparatus of the invention shown in an intermediate position, together with a portion of a workpiece and work platform.
Figure 7:
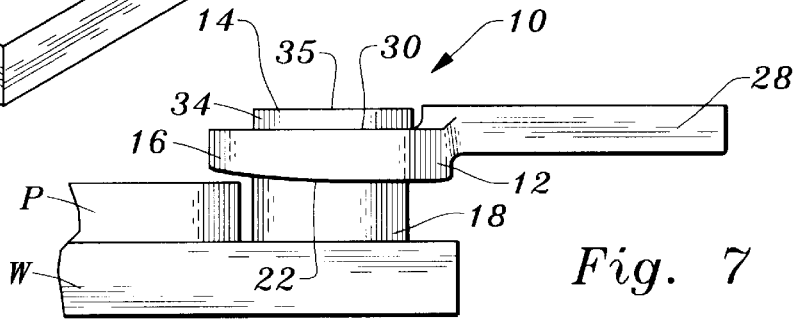
FIG. 7 is a side elevation view of the clamp apparatus of FIG. 6 shown together with a portion of a work piece and work platform.

When locking body 12 is rotated clockwise towards the closed or locking position, the cutout portion 24 of locking disc 16 is moved away from work piece P such that locking disc 16 extends over workpiece P. Also as locking body rotates towards the closed position, the tapered or eccentric shape of cam or locking disc 16 results in an increasingly thicker portion of locking disc rotatably moved adjacent workpiece P, such that the tapered lower cam surface 22 of locking disc approaches workpiece. FIG. 6 and FIG. 7 show locking body 12 in a position which is intermediate between the open and locking positions. As locking body 12 moves into the locking position, the tapered lower surface 22 of locking disc 16 engages workpiece P so that locking disc 16 exerts a locking or holding force against workpiece P to hold workpiece P firmly against work platform W. Locking disc 16 thus acts as a cam body to exert a cam force against workpiece P via tapered cam surface 22. The chamfer or bevel 32 (FIG. 10) in tapered lower surface 22 is provided to prevent damage to workpiece P due to excessive force being exerted thereon by locking disc 16 when in the closed position. When locking body 12 is rotated counterclockwise from the locking position towards the open position, the tapered cam surface 22 on locking disc disengages and moves away from workpiece P, and when locking body has been returned to the open position, the cutout portion of locking disc 16 allows workpiece P to be removed.

Figure 3:
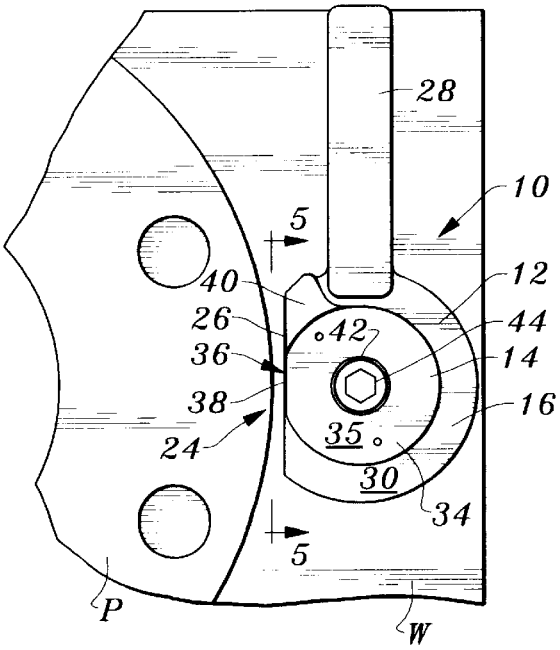
FIG. 3 is a top plan view of the clamp apparatus of FIG. 1 shown together with a portion of a work piece and work platform.

Thus, in operation, a user of the invention would grasp handle 28 and exert a force thereon sufficient to overcome the traction generated by O-ring 54 between mounting member 14 to and locking body 12, so that locking body is rotated counterclockwise to the open position described above wherein cutout portion 24 is positioned adjacent the location at which the workpiece P will be clamped. Workpiece P is then positioned adjacent socket portion 18 of locking body 12 as shown in FIG. 3, and locking body 12 is rotated clockwise towards the closed position by applying suitable force to handle 28 until the tapered lower surface 22 of locking disc has firmly engaged workpiece P to hold or clamp workpiece onto work platform W. Once machining or other operations on workpiece P have been completed, a user again grasps handle 28 and applies sufficient force to disengage tapered cam surface 22 from workpiece P and rotate locking body 12 counterclockwise to the open position again so that workpiece P can be removed from work platform W. Additional clamp apparatus 10 may positioned elsewhere on work platform W to hold other portions of workpiece P.

Figure 2:
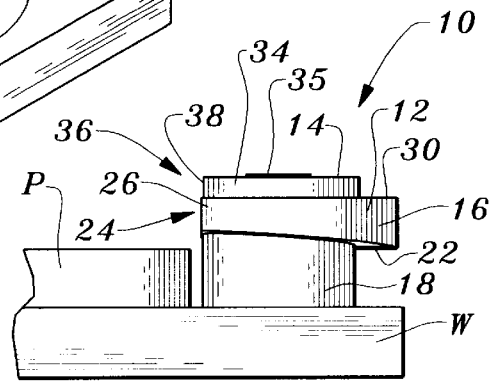
FIG. 2 is a side elevation view of the clamp apparatus of FIG. 1 shown together with a portion of a work piece and work platform.
Figure 8:
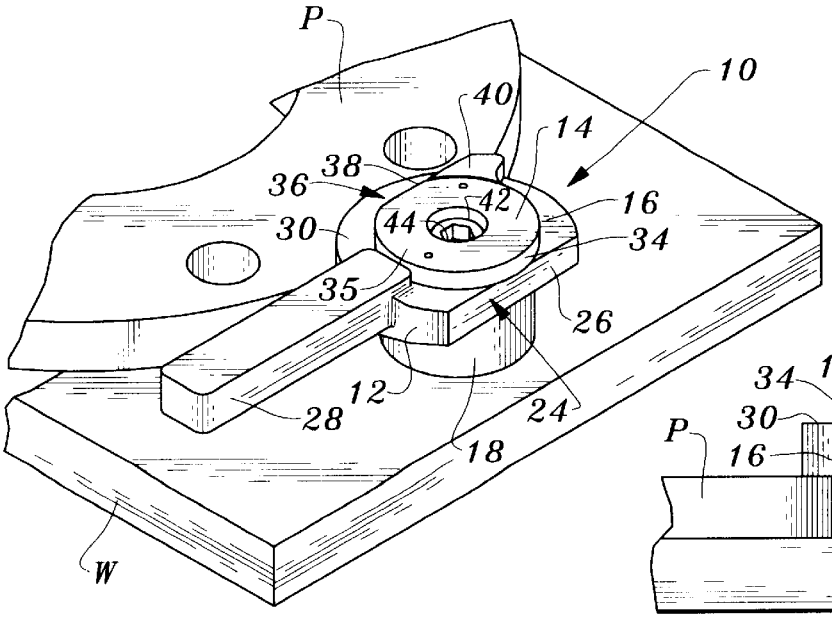
FIG. 8 is a perspective view of the clamp apparatus of the invention shown in a closed or locking position, together with a portion of a workpiece and work platform.
Figure 9:
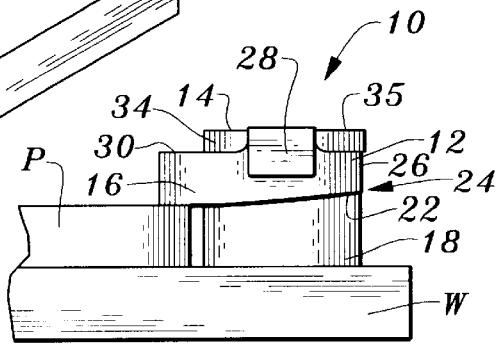
FIG. 9 is a side elevation view of the clamp apparatus of FIG. 8 shown together with a portion of a work piece and work platform.

Note that in the locked position shown in FIG. 8 and FIG. 9, locking body is depicted as being generally one hundred and eighty degrees of rotation away from the open position shown in FIG. 1 through FIG. 3. The actual closed or locking position of locking body 12, however, may vary somewhat, depending upon the thickness of workpiece P and the point of rotation of locking body 12 at which tapered surface 22 of locking disc 12 actually engages and "locks" the underlying workpiece P. The degree of taper or pitch of the cam surface 22, or the degree of eccentricity of locking disc 16, may also be varied if desired to provide a smaller arc or amount of rotation between the opened and closed positions of locking body 12.

The cam lock clamp apparatus advantageously utilizes the lower surface of locking disc 16 as a cam surface, rather than utilizing an edge of the disc. Conventional camming arrangements typically use the edge of an eccentric cam body to interact with a cam follower or other item. By arranging the eccentricity of locking disc 16 such that the broad lower surface 22 of locking disc 16 is the cam surface instead of the edge of locking disc 16, as provided by the present invention, a much greater cam surface area is available to create a greater clamping force than would be provided by an edge cam surface. In other words, the cam surface 22 of locking disc 16 is substantially, but not completely, perpendicular to the rotational axis 56 of locking disc 16 and locking body 12. This arrangement allows a much large cam surface area than is available from using only an edge as a cam surface, where the cam surface would be generally parallel to the rotational axis. The larger cam surface provided by the invention increases locking or clamping power and reduces or eliminates inadvertent shifting or unlocking of workpiece P due to vibration which may occur during industrial operations on workpiece P while workpiece P is clamped. Locking disc 16 need not actually be eccentrically shaped as long as the lower surface 22 of locking disc 16 is tapered in shape or otherwise angled with respect to workpiece P such that it provides a cam surface to exert a locking force on workpiece P as locking body 12 is rotated.

The stop 40 on mounting member 14 provides means for preventing handle 28 and cutout portion 24 of locking disc 16 from inadvertently moving past the open position in a manner which could hinder removal of workpiece P from work platform W. In typical operations, a user may need to exert substantial force on handle 28 in order to overcome the friction between the cam surface 22 of locking disc 16 and workpiece P to release workpiece P and return locking body 12 to the open position. In exerting such force, locking body 12 can "spring" open and rotate counterclockwise past the open position described above such that handle 28 and locking disc 16 move into a position which is over or partly over workpiece P. The workpiece P then cannot be removed from work platform W until the user again rotates locking body 12 clockwise to move handle 28 away from workpiece P and position cutout section 24 adjacent workpiece P. Such additional positioning of locking body 12 to remove workpiece P adds additional time, effort and expense to machining operations. The present invention avoids this situation by providing stop 40 on mounting member 14, with stop positioned to abut, block or otherwise stop handle 28 when locking body 12 is in the open position and thereby prevent locking body 12 from rotating past or beyond the open position in an inconvenient manner.

Depending upon the size, shape and thickness of workpiece P, the "open" position defined by stop 44 may vary. Particularly, the shape and thickness of a particular workpiece may be such that the angle of arc between the open and closed positions for locking body 12 is less than one hundred and eighty degrees. In such a situation, bolt 44 may be loosened, and mounting member 14 rotated about bolt 44 to move stop 40 to a more optimal position, after which bolt 44 is again tightened to secure mounting member 14 in place. Note also that handle 28 could be omitted from locking body 12 and replaced by any other structural feature suitable for interacting with stop 40 in a manner which interrupts rotation of locking body 12 past the open position. In such situations, locking body 12 could be rotated by use of a suitable tool instead of a handle.

A substantial amount of the forces exerted on clamp apparatus 10 during use are ultimately transferred to the serrated lower surface 50 of mounting member 14. The arrangement of radially extending serrations 48 on lower surface 50 firmly hold mounting member 14 in place against work platform W and prevent unwanted rotation thereof. The O-ring 54, which provides traction between mounting member 14 and locking body 12, is the only portion of the clamp apparatus 10 which is subject to substantial wear during use. O-ring 54 is relatively inexpensive and can be easily replaced by simply loosening and removing bolt 44 and disengaging mounting member 14 from bore to access O-ring 54. The clamp apparatus 10 of the invention thus avoids complex and time consuming disassembly and repair, or expensive part replacement, as occurs in many previously used clamping systems. O-ring 54 could alternatively be replaced by a resilient flat washer, or other inexpensive elastomer part positioned between mounting member and locking body 12, which is easily removed and inexpensively replaced.

Figure 11:
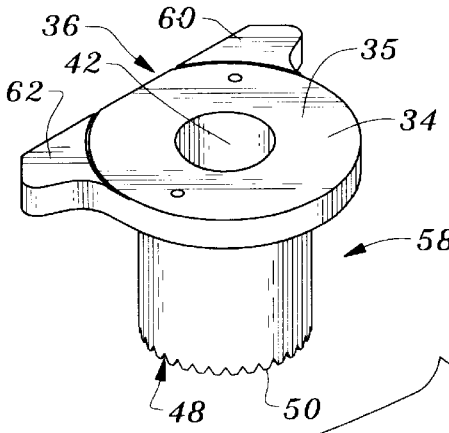
FIG. 11 is an alternative embodiment mounting member in accordance with the invention.
Figure 10:
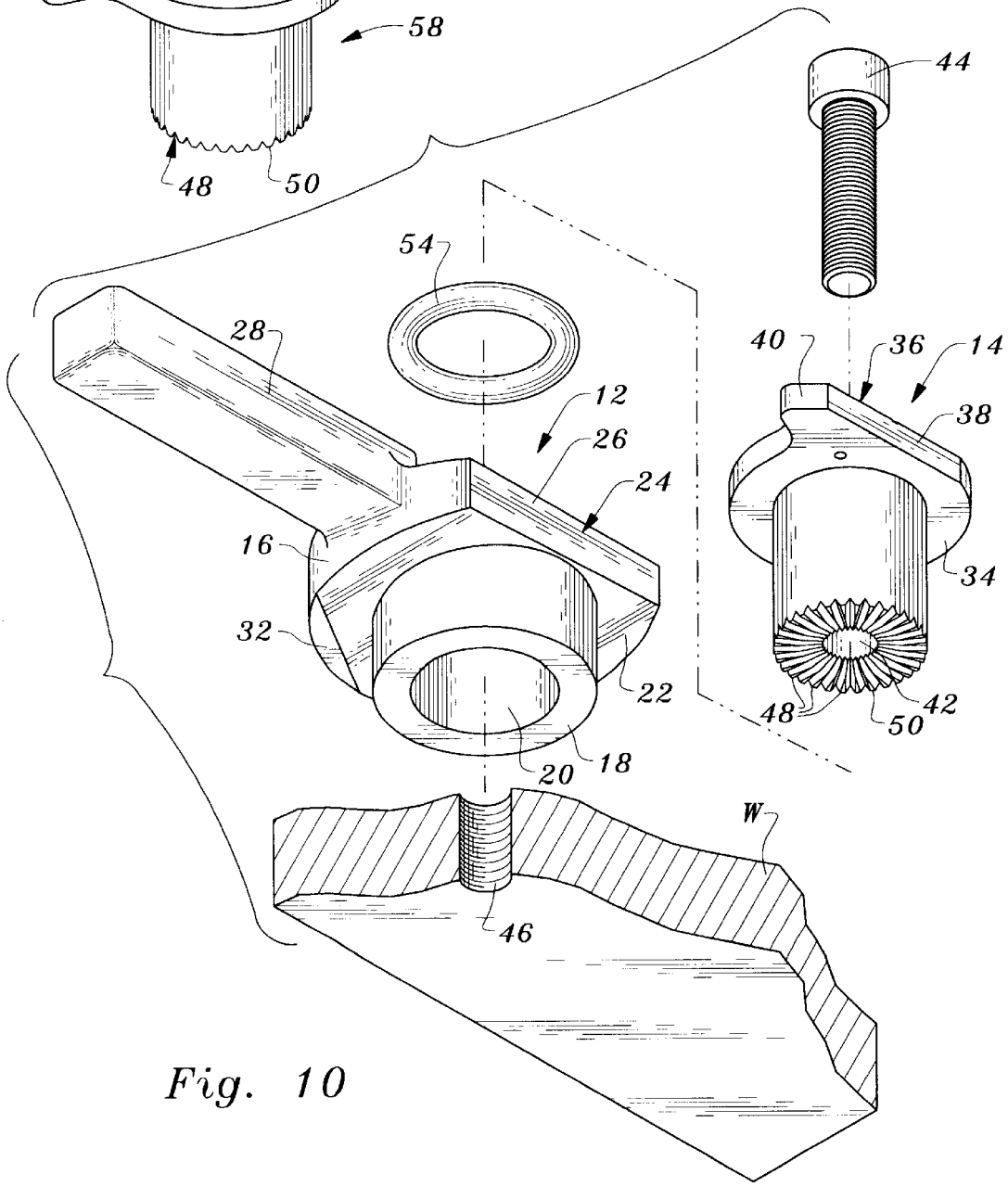
FIG. 10 is an exploded view of the clamp apparatus of the invention.

Referring now to FIG. 11, there is shown an alternate embodiment mounting member 58 in accordance with the invention, wherein like reference numbers denote like parts. Mounting member 58 includes first and second stops 60, 62 on flange 34, with stops 60, 62 positioned generally on opposite sides of cutout section 36. Mounting member 58 is structured and configured to fit within bore 20 of locking body 12, and is assembled with locking body 12 and mounted on work platform W in the manner described above. When thus assembled, stops 60, 62 are positioned to prevent handle 28 and locking body 12 from rotating past both the open position and the locked position described above. Thus, when in the open position, handle 28 will abut stop 60, and when in the locked position, handle 28 will abut stop 62. The mounting member 58 is desirable in situations where too much closing force by cam surface 22 against workpiece P could result in damage to workpiece P. Stop 62 prevents locking body 12 from rotating past a certain level of locking force against the workpiece P to avoid such damage.

Accordingly, it will be seen that this invention provides a clamp apparatus which allows quick and easy releasible holding of a workpiece during industrial operations, and which prevents movement of a workpiece during such operations due to vibration or machining forces exerted against the workpiece. Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A clamp apparatus for holding a workpiece, comprising:

(a) a locking body, said locking body including a rotational axis, said locking body including a tapered tower locking surface, said tapered lower locking surface substantially perpendicular to said rotational axis, said locking body including a cutout portion, said locking body including a bore;

(b) a mounting member, said mounting member structured and configured to fit within said bore in said locking body, said locking body rotatably mounted on said mounting member about said rotational axis;

(c) said locking body rotatably moveable between a locking position wherein said lower locking surface exerts a clamping force against said workpiece, and an open position wherein said cutout portion is adjacent said workpiece;

(d) means for generating traction beteween said locking body and said mounting member; and (e) means for fixedly coupling said mounting member to a work platform.

2. A clamp apparatus as recited in claim 1, wherein said locking body comprises:

(a) a locking disc, said tapered lower surface included on said locking disc, said cutout portion included on said locking disc; and (b) a socket portion, said socket portion joined to said locking disc, said bore extending through said socket portion and said locking disc.

3. A clamp apparatus as recited in claim 1, wherein said mounting member includes a flange adjacent an upper end, said flange including a cutout section.

4. A clamp apparatus as recited in claim 1, wherein said locking member further comprises a handle.

5. A clamp apparatus as recited in claim 4, wherein said mounting member further comprises at least one stop.

6. A clamp apparatus as recited in claim 1, wherein said means for generating traction between said locking body and said mounting member comprises an o-ring, said o-ring positioned within said bore of said locking body.

7. A clamp apparatus as recited in claim 1, wherein said means for fixedly coupling said mounting member to said work platform comprises:

(a) a threaded bolt, said threaded bolt structured and configured to engage a threaded hole in said work platform; and (b) said mounting member including a bore, said bore structured and configured to receive said threaded bolt.

8. A clamp apparatus as recited in claim 7, wherein said means for fixedly coupling said mounting member to said work platform further comprises a plurality of serrations on a lower surface of said mounting member.

9. A clamp apparatus, comprising:

(a) a locking body, said locking body including a rotational axis, said locking body including a tapered lower locking surface, said tapered lower locking surface substantially perpendicular to said rotational axis, said locking body including a cutout portion, said locking body including a bore, said locking body including a handle;

(b) a mounting member, said mounting member including a stop, said locking body rotatably mounted on said mounting member about said rotational axis;

(c) said locking body rotatably movable between a locking position wherein said lower locking surface exerts a clamping force against said workpiece, and an open position wherein said cutout portion adjacent said workpiece;

(d) an elastomeric o-ring said elastomeric o-ring position in said bore between said locking body and said mounting member; and (e) means for fixedly coupling said mounting member to a work platform.

10. A clamp apparatus as recited in claim 9, wherein said locking body comprises:

(a) a locking disc, said tapered lower surface included on said locking disc, said cutout portion included on said locking disc; and (b) a socket portion, said socket portion joined to said locking disc, said bore extending through said socket portion and said locking disc.

11. A clamp apparatus as recited in claim 10, wherein said mounting member includes a flange adjacent an upper end, said stop included on said flange, said flange including a cutout section, said cutout section having a flat edge.

12. A clamp apparatus as recited in claim 10, wherein said means for fixedly coupling said mounting member to said work platform comprises:

(a) a threaded bolt, said threaded bolt structured and configured to engage a threaded hole in said work platform; and (b) said mounting member including a bore, said bore structured and configured to receive said threaded bolt.

13. A clamp apparatus as recited in claim 9, wherein said means for fixedly coupling said mounting member to said work platform further comprises a plurality of radial serrations on a lower surface of said mounting member.

14. A clamp apparatus as recited in claim 9, wherein said locking body rotates about said mounting member between an open position and a locking position.

15. A clamp apparatus as recited in claim 14, wherein said handle on said locking body is adjacent said stop on said mounting member when said locking body is in said open position.

16. A clamp apparatus, comprising:

(a) locking body, said locking body including a rotational axis, said locking body including a locking disc, said locking body including a socket portion, said socket portion joined to said locking disc, said locking disc including a tapered bottom locking surface, said locking surface substantially perpendicular to said rotational axis, said locking disc including a cutout portion, said disc including a handle adjacent said cutout portion, said locking body including a bore, said extending through said socket portion and said locking disc;

(b) a mounting member, said mounting member including a stop, said mounting member rotatably received by said bore in said locking body, said mounting member including a bore;

(c) said locking body rotatably movable between a locking position wherein said lower locking surface on said locking disc exerts a clamping force against said workpiece, and an open position wherein said cutout portion on said locking disc is adjacent said workpiece;

(d) an elastomeric o-ring, said elastomeric o-ring positioned in said bore between said locking body and said mounting member; and (e) means for fixedly coupling said mounting member to a work platform.

17. A clamp apparatus as recited in claim 16, wherein said mounting member includes a flange adjacent an upper end, said stop included on said flange, said flange including a cutout section.

18. A clamp apparatus as recited in claim 16, wherein said means for fixedly coupling said mounting member to said work platform comprises:

(a) a threaded bolt, said threaded bolt structured and configured to engage a threaded hole in said work platform;

(b) said mounting member including a bore, said bore structured and configured to receive said threaded bolt; and (c) a plurality of radially extending serrations on a lower surface of said mounting member.

19. A clamp apparatus as recited in claim 16, wherein said locking body rotates about said mounting member between an open position and a locking position.

20. A clamp apparatus as recited in claim 19, wherein said handle on said cam disc abuts said stop on said member when said locking body is in said open position.

* * * * *